United States Patent [19]

Brunner et al.

[11] 3,945,013

[45] Mar. 16, 1976

[54] DOUBLE OMNI-DIRECTIONAL ANTENNA

[75] Inventors: Anton Brunner, Wangen, Starnberg; Nikolaus Willburger, Olching, both of Germany

[73] Assignee: Siemens Aktiengesellschaft, Berlin & Munich, Germany

[22] Filed: Oct. 23, 1974

[21] Appl. No.: 517,233

[30] Foreign Application Priority Data

Oct. 31, 1973 Germany ..... 2354550

[52] U.S. Cl. ..... 343/708; 343/729; 343/791; 343/830

[51] Int. Cl.[2].. H01Q 1/28; H01Q 1/00; H01Q 9/04; H01Q 9/38

[58] Field of Search ..... 343/725, 727, 729, 730, 343/767, 768, 790–792, 829–831, 826, 827, 844, 893, 708; 333/84 L, 97 R

[56] References Cited

UNITED STATES PATENTS

| | | | |
|---|---|---|---|
| 2,479,227 | 8/1949 | Gilbert | 343/729 |
| 2,480,186 | 8/1949 | Gilbert | 343/830 X |
| 2,735,093 | 2/1956 | Krausz et al. | 343/725 |
| 2,821,709 | 1/1958 | Fucci | 343/790 X |
| 3,019,437 | 1/1962 | Hoadley | 343/725 |
| 3,739,390 | 6/1973 | Poppe, Jr. et al. | 343/729 |

FOREIGN PATENTS OR APPLICATIONS

| | | | |
|---|---|---|---|
| 959,928 | 10/1949 | France | 343/790 |

*Primary Examiner*—Paul L. Gensler
*Attorney, Agent, or Firm*—Hill, Gross, Simpson, Van Santen, Steadman, Chiara & Simpson

[57] ABSTRACT

A double omni-directional antenna for use with a transponder is disclosed allowing simultaneous operation within two different frequency bands. A double coaxial line is provided having outer, central, and inner concentric conductors. The outer and central conductors form a coaxial feed for a lower frequency antenna and the central and inner connectors form a coaxial feed for a high frequency antenna. The higher frequency antenna is located directly above the lower frequency antenna and each is either a unipole for vertically polarized radiation or a slot radiator for horizontally polarized radiation.

23 Claims, 7 Drawing Figures

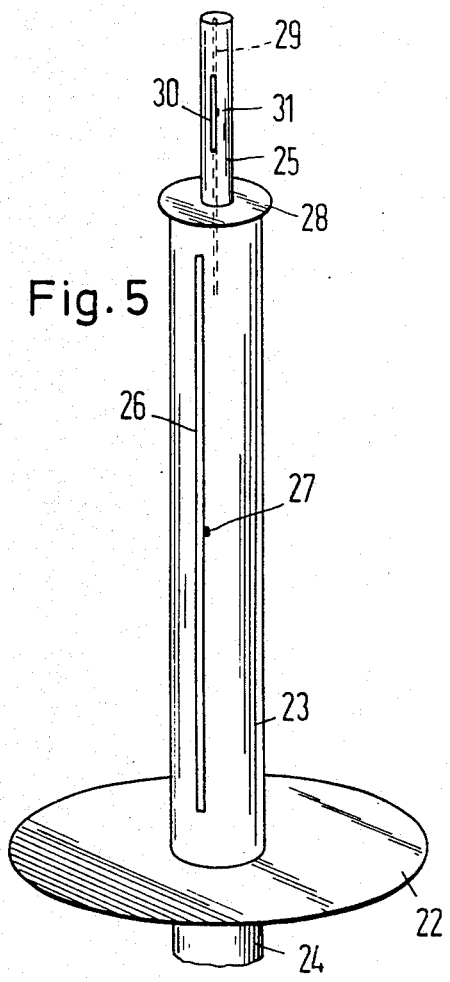
Fig. 5
Fig. 6
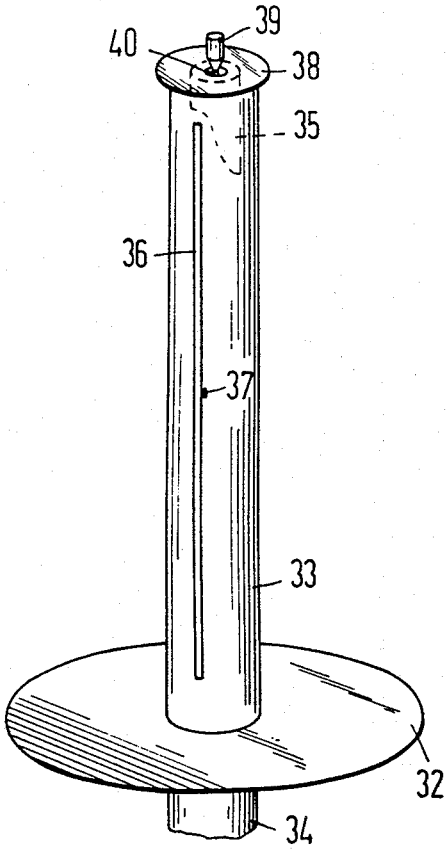
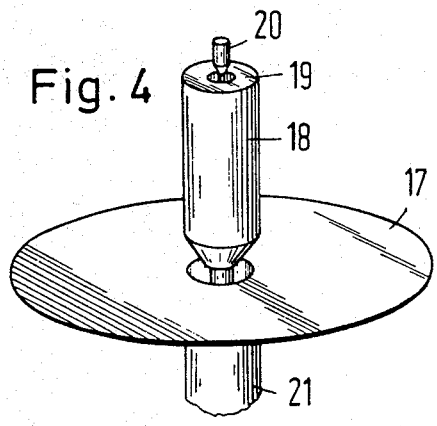
Fig. 4
Fig. 7
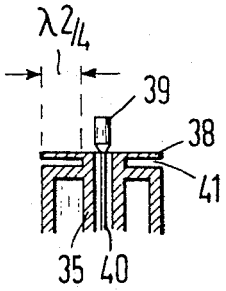

DOUBLE OMNI-DIRECTIONAL ANTENNA

BACKGROUND OF THE INVENTION ; 1. Field of the Invention

The present invention relates generally to antennas and more particularly to a double omni-directional antenna for simultaneous operation from a single structure at two different frequencies.

2. Description of the Prior Art

For the purpose of simultaneous reception and radiation of electro-magnetic waves in two different frequency bands with two specific, linear, mutually perpendicular polarization planes, the horizontal plane containing an omni-directional pattern and the vertical plane a wide radiation pattern, it is well-known to employ two individual radiators chosen in accordance with the particular desired polarization which are set up one beside the other. A unipole may be chosen to produce vertically polarized radiation and a slot radiator to provide horizontal radiation. However, with this kind of arrangement, mutual influencing of the two antennas takes place and therefore, interference results of a kind which in most applications cannot be accepted, particularly when these antennas are used in secondary radar transponder equipment which has to simultaneously effect identification at two frequencies.

SUMMARY OF THE INVENTION

An object of the present invention is to provide an integrated, double omni-directional antenna so that each of the two antennas can be employed either for vertically or horizontally polarized waves without incurring the indicated drawbacks of systems in which two separate antennas are arranged side by side.

A further object is to provide a single antenna structure requiring only one mounting hole for fitting the antenna.

In accordance with this invention, a double coaxial line comprising an inner, a central, and an outer conductor arranged in a vertical configuration is provided. For a lower frequency band, a lower coaxial line section formed by the central and outer conductors, serves as a radiator. The central conductor forms the inner coaxial conductor and the outer conductor forms the outer coaxial conductor thereof. For the higher frequency band, an upper coaxial line section effective as a radiator is formed by the inner and central conductors so that the inner conductor forms the inner coaxial conductor, and the central conductor forms the outer coaxial conductor thereof. Each coaxial line section is designed either as a known kind of unipole for operation in respect of vertically polarized electro-magnetic waves or, for horizontally polarized electro-magnetic waves, as a known type of slot radiator. In a unipole, the outer conductor of the particular coaxial line section is flared into a circular ground plate while the associated inner coaxial conductor is formed as a quarterwave rod radiator. In a known kind of slot radiator, the outer conductor of the particular coaxial line section is provided with an axial slot having a length corresponding to about half the wavelength of the electromagnetic waves with which the particular coaxial line section is intended to operate. At the edge of said slot, substantially at the center of its length, a short-circuiting pin is provided between the outer coaxial conductor and the inner coaxial conductor of the particular coaxial line section.

Depending upon the polarization required for a given frequency band, either a known kind of unipole radiator or a known kind of slotted coaxial line radiator (technical report of the FTZ Research Institute; "Small-sized Microwave Antennas With An Omni-directional Pattern," by H. Hollman, Deutsche Bundespost, FTZ 454/T Br 6, February 1969) is used for the associated coaxial line section.

The objects of the invention are achieved by this structure since the omni-directional characteristics of the two integrated radiators on a common axis are not disturbed as in the case of two individual radiators set up side by side. Also, the double coaxial line to the two antennas restricts drilling to a single hole in the wall of the vehicle or airborne vehicle to which the antenna is fitted.

The other objects, features and advantages of the present invention will be apparent from the following description taken in conjunction with the accompanying drawings.

BRIEF DESCRIPTION OF THE DRAWINGS

FIGS. 4 to 6 illustrate other transponder double omni-directional antennas of different design, in perspective views; and FIG. 7 is a partial view of a vertical cross-section illustrating the design of a folded top system when using a unipole radiator for the higher frequency.

DESCRIPTION OF THE PREFERRED EMBODIMENTS

Figure 1:
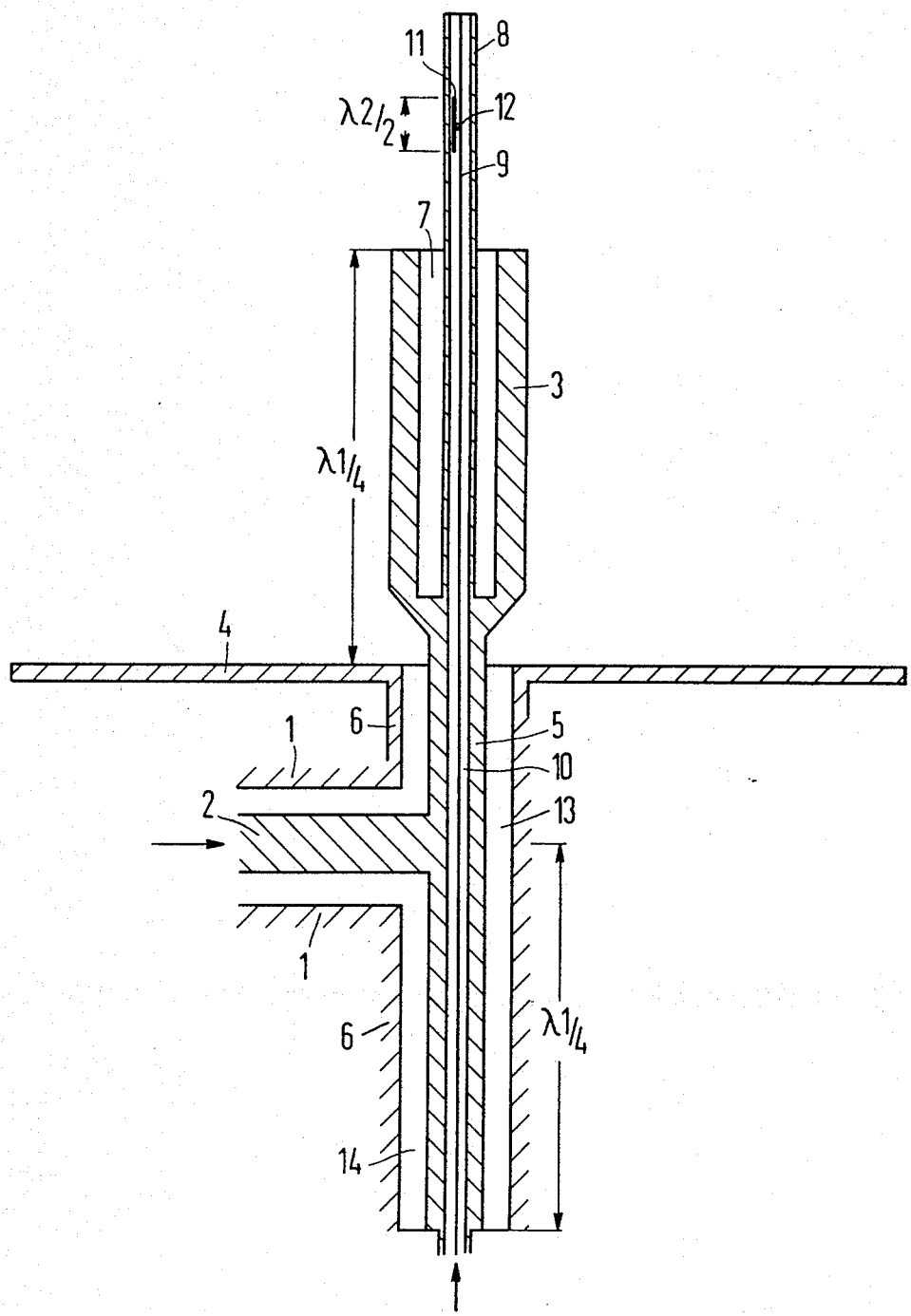
FIG. 1 is a view in vertical cross-section illustrating a transponder double omni-directional antenna for operation with electro-magnetic waves of a lower frequency band using vertical polarization and with those of a higher frequency band using horizontal polarization.

In FIG. 1, a double antenna fed through a double coaxial line is shown consisting of two omni-directional antennas built one on top of the other, for use in a transponder with an identification system (civil or friend-or-foe identification) operating at two frequencies. It should be clearly understood that other systems requiring transmissions at different frequencies could likewise use this invention.

As used in the drawings and as hereinafter used, the term $\lambda$ ¼ means a quarter wave length in the lower frequency band (band 1) while $\lambda$ 2/2 means a half wave length in the higher frequency band (band 2).

The design illustrated in FIG. 1 includes an omni-directional antenna for a lower frequency band, and is constituted by a unipole radiator forming the lower antenna. This unipole radiator is fed by an external, radially introduced coaxial feeder comprising an outer conductor 1 and an inner conductor 2. The inner conductor 2 forms a T-branch with the inner coaxial conductor 5 of an external coaxial line 13 which merges into a rod-type radiator 3. The outer conductor 1, after the branch, merges through the outer conductor 6 of the external coaxial line 13 into a circular ground plate 4. The length of the rod radiator 3 projecting out of the ground plate 4 is about a quarter of the wave length of the electro-magnetic waves of the lower frequency and longer wavelength λ1.

Inside the bored-out central conductor 5 of the double coaxial line, which conductor forms the inner coaxial conductor of the external coaxial line 13, there runs a thin, inner conductor 9 of the double coaxial lines such that electro-magnetic waves of a higher frequency and shorter wavelength λ2 can be transmitted along the inner coaxial line 10 formed by the inner conductor 9 and the central conductor 5 to feed the upper antenna. The inner coaxial line 10 has an effective diameter of about one sixth of the wave length λ2 corresponding to the higher frequency band. This inner coaxial line 10 projects beyond the rod-type radiator 3 and exhibits an axial slot 11 in the central conductor extension 8. At the lengthwise center of the slot 11 and at the edge thereof, a short-circuiting pin 12 effecting a short-circuit to the inner conductor 9 is arranged. The slot 11 has a length corresponding to about half the wave length λ2 of the electro-magnetic waves of the higher frequency band. By the introduction of the short-circuiting pin 12, the slot 11 of the inner coaxial line 10 is excited in a way well known in the art to provide an omni-directional radiation pattern.

A ripple in the omni-directional pattern of the upper antenna can be reduced by the provision of a second slot of the same size, offset through 180° at the circumference. No short-circuiting pin is required in the second slot. This slot has not been shown in FIG. 1.

If the inner coaxial line 10 is arranged vertically, then electro-magnetic waves of the higher frequency band will be radiated with horizontal polarization. In contrast, the lower unipole antenna, formed by the ground plate 4 and the rod-type radiator 3, radiates electro-magnetic waves of the lower frequency band with vertical polarization in an omni-directional pattern because the rod radiator 3 is vertically positioned.

To prevent the outer conductor 8 of the inner coaxial line 10 from being excited by electro-magnetic waves of the lower frequency band, the rod radiator 3 has a folded top arrangement 7 with a depth corresponding to about a quarter of a wavelength of the electro-magnetic waves λ1 of the lower frequency band to provide a current barrier.

The separation of the feeder points for the two frequency bands is achieved by use of a double coaxial line with the inner coaxial line 10 assigned to the higher frequency band and by assigning the outer coaxial line 13 formed by the conductors 5 and 6 to the lower frequency band. The outer coaxial line 13 is fed by the radial branching of outer conductor 1 and inner conductor 2 at a point of about a quarter of the wavelength of the electro-magnetic wave λ1 above a short-circuit between the central conductor 5 and the outer conductor 6 at the bottom of the coaxial line 13. This short-circuit arrangement forms a folded section 14 which transforms the short-circuit a quarter of a wavelength λ1 distant into an open-circuit at the branch point so that the energy carried by the lower frequency band feeder constituted by inner conductor 1 and outer conductor 2 flows in the desired branch direction, i.e., upwards. The inner coaxial line is fed at the bottom of the structure to inner conductor 9 and the short circuit between outer conductor 6 and central conductor 5.

The attenuation along the inner coaxial line 10 is in the order of magnitude of a few tenths of a decibel. To transfer the electromagnetic energy onwards, in particular the higher frequency energy, it is equally possible to use a waveguide.

Figure 2:
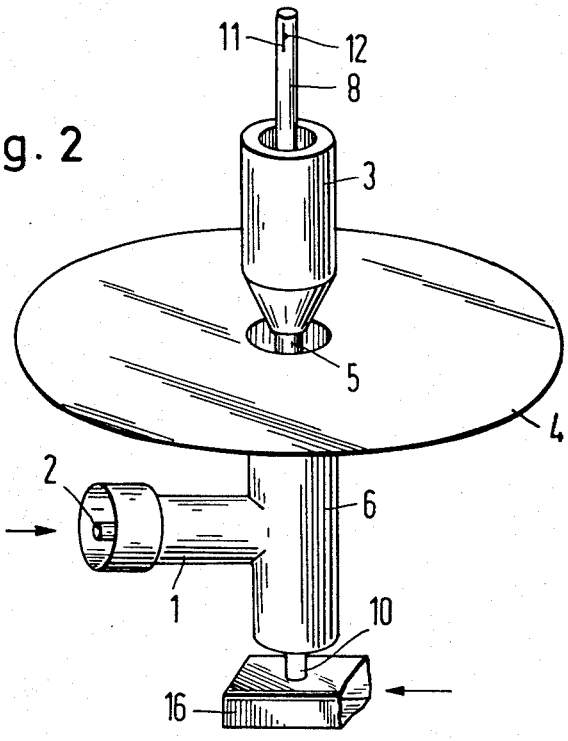
FIG. 2 is a perspective view of the antenna shown in FIG. 1.

A perspective view of the integrated double antenna for transponder applications, shown in FIG. 1, is illustrated in FIG. 2. This antenna, with the exception of the radial branchingg of the low frequency coaxial feeder line, is constructed to exhibit rotational symmetry with respect to inner conductor 9 and is, therefore, suitable in particular for terrestrial vehicles and ships.

Figure 3:
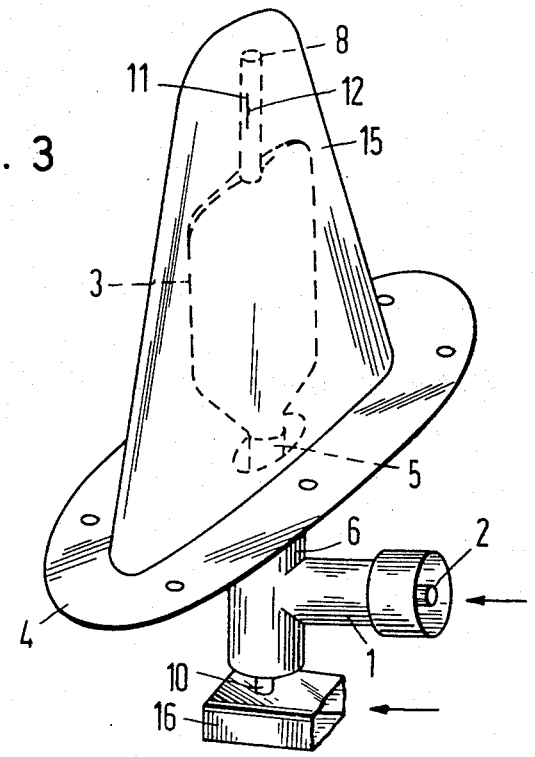
FIG. 3 is a perspective view of a double antenna which functionally corresponds with that of FIG. 1 but which, because of its intended application in aircraft, has a more suitable aerodynamic design.

If application to faster vehicles is envisaged, e.g., aircraft, then a streamlined design of the thin antenna shown in perspective view in FIG. 3 will be employed. This antenna has the same function as that shown in FIGS. 1 and 2. The rod-radiator 3, instead of exhibiting rotational symmetry, is of an elongated, flat form. The ground plate 4 likewise has an elongated profile in adaptation to the direction of the rod-radiator 3. It is enlarged by the surface of the aircraft. The inner coaxial line 10 projects out from elongated rod-radiator 3 in an upward direction serving as a slotted coaxial radiator. The structure is enclosed in a plastic fin 15 whose form is matched to that of the radiator 3.

In the arrangements of FIGS. 2 and 3, the supply to the inner coaxial line 10 is effected through an ongoing waveguide 16 to minimize attenuation.

FIGS. 4 to 6 illustrate other double omni-directional antennas in perspective views, which illustrate some of the other possible combinations of radiated polarization planes between the lower antenna, assigned to the lower frequency band, and the upper antenna, assigned to the higher frequency band.

In FIG. 4, two unipoles have been built one on top of the other. Here, with vertical assembly, both radiators produce vertical polarization. The lower unipole, assigned to the lower frequency band, consists of the ground plate 17 and the rod-type radiator 18 which are electrically connected to the external and central conductors respectively, of a double coaxial line 21. The unipole assigned to the higher frequency band is comprised of the ground plate 19 and the rod-type radiator 20. The ground plate 19 is formed by the top surface of the central conductor (of double coaxial line 21) forming the rod-type radiator 18, and the rod-type radiator 20 is formed by upwardly extending the inner conductor of the double coaxial line 21.

In FIG. 5, two slotted coaxial line radiators have been assembled one above the other. Here, with vertical direction, both radiators produce horizontal polarization. The lower radiator, assigned to the lower frequency band, is comprised of a ground plate 22 which is electrically connected to the external conductor 23 and also of the central conductor 25 of the double coaxial line 24 which passes through the interior of the outer conductor 23. The outer conductor 23 is provided with an axial slot 26, the center of which is connected by a short-circuiting pin 27 to the central conductor 25. The upper radiator, assigned to the higher frequency band, is comprised of a ground plate 28 arranged on the outer conductor 23 and connected electrically to the central conductor 25 and also of the inner conductor 29 shown by dotted lines positioned interiorly of central conductor 25. The central conductor 25 is provided with an axial slot 30, the center of which is connected by short-circuiting pin 31 to the inner conductor 29. The slot length in each case amounts to half the wavelength radiated by the particular coaxial line radiator.

In FIG. 6, a unipole radiator is assembled above a slotted coaxial radiator. Here, with vertical erection, the lower radiator produces horizontal polarization and the upper radiator vertical polarization. The lower radiator, assigned to the lower frequency band, is comprised of a ground plate 32 which is electrically connected to the outer conductor 33 of a double coaxial line 34 and also of a central conductor 35, shown by dotted lines, positioned interiorly of outer conductor 33. The outer conductor 33 is provided with an axial slot 36, the center of which is connected by a short-circuiting pin 37 to the central conductor 35. The slot length is about half the wavelength of radiation of this radiaor. The unipole assigned to the higher frequency band positioned on top of the slotted coaxial line radiator is comprised of a ground plate 38 which is electrically connected to central conductor 35 shown by dotted lines, and also of a rod-type radiator 39 which is an upward continuation of inner conductor 40 of the double coaxial line 34.

As FIG. 7 shows in cross-section, the ground plate 38 of FIG. 6 can be so designed that beneath it a rotationally symmetrical folded top system 41, having a height corresponding approximately to a quarter of the wavelength of the electro-magnetic waves $\lambda 2$ of the higher frequency band, is created. Such a construction reduces excitation of the outer conductor 33 by the high frequency unipole with the rod-radiator 39. A corresponding folded top design can also be used in the case of the ground plate 19 of the antenna system shown in FIG. 4.

The unipole radiation pattern for the low or high frequency configurations can be individually designed by variation of the shapes of the ground plates.

Although the invention is pictured in a vertical configuration, it should be understood that the device may be tilted in any direction.

It will be apparent that many modifications and variations may be effected without departing from the spirit and scope of the novel concepts of this invention.

We claim as our invention:

1. A double omni-directional antenna for electromagnetic waves falling within two different frequency bands comprising a double coaxial line including an inner, a central and an outer conductor which in a vertical position comprise with respect to the lower of said frequency bands a lower coaxial line section as a low frequency omni-directional radiator formed by said central and said outer conductors, said central conductor being the inner conductor of said lower coaxial line section and said outer conductor being the outer conductor of said lower coaxial line section, and which for the higher of said frequency bands comprise an upper coaxial line section above said lower coaxial line section as a high frequency omni-directional radiator formed by said inner and said central conductors, said inner conductor being the inner conductor of said upper coaxial line section and said central conductor being the outer conductor of said upper coaxial line section.

2. A double omni-directional antenna for electromagnetic waves falling within two different frequency bands as claimed in claim 1, in which each of said coaxial line sections is constructed as a unipole for operation with respect to vertically polarized waves and in which the outer conductor of each of said coaxial line sections is bent over to act as a ground plate while the associated inner conductor is formed as a low frequency quarter wave rod radiator for the lower coaxial line section and as a high frequency quarter wave rod radiator for the upper coaxial line section.

3. A double omni-directional antenna for electromagnetic waves falling within two different frequency bands as claimed in claim 1, in which the outer conductor of said upper coaxial line section is provided with an axial slot having a length corresponding to approximately half of the wave length of the electromagnetic waves with which said upper coaxial line section is intended to operate and in which a short circuiting pin is provided between the outer conductor and the inner conductor of said upper coaxial line section, said pin being located substantially at the center of said slot and at he edge of said slot.

4. A double omni-directional antenna for electromagnetic waves falling within two different frequency bands as claimed in claim 1, in which the outer conductor of said upper coaxial line section is provided with an axial slot having a length corresponding to approximately half of the wave length of the electromagnetic waves with which said upper coaxial line section is intended to operate and in which said outer conductor of said upper coaxial line section has a second slot circumferentially offset through approximately 180° with respect to said first slot.

5. A double omni-directional antenna for electromagnetic waves falling within two different frequency bands as claimed in claim 1, in which said lower coaxial line section is a unipole and said upper coaxial line section is a radiator having a slot and a short circuiting pin and in which said central conductor of said double coaxial line acts as a folded top rod-type radiator of the unipole and is arranged above the outer conductor bent over as a ground plate of the unipole.

6. A double omni-directional antenna for electromagnetic waves falling within two different frequency bands as claimed in claim 1, which is characterized by a rotationally symmetrical design.

7. A double omni-directional antenna for electromagnetic waves falling within two different frequency bands as claimed in claim 1, which includes a base plate below said upper radiator forming a unipole assigned to the higher frequencies, and below said base plate there being a rotationally symmetrical quarter wave folded top system.

8. A double omni-directional antenna for electromagnetic waves falling within two different frequency bands as claimed in claim 1, in which the lead-in to said upper coaxial line section comes in from below by means of the connection of the inner and central conductors of the double coaxial line to a coaxial feeder and the lead-in to the lower coaxial line section is brought in radially from the side by connection of said central and outer conductors of said double coaxial line to another feeder.

9. A double omni-directional antenna for electromagnetic waves falling within two different frequency bands as claimed in claim 8, in which downwardly from the radial lead-in there extends a quarter-wave folded top system for the electromagnetic waves of the lower frequency band, and a short circuit connection between the outer and central conductors of said lower coaxial line section located at a quarter of a wavelength.

10. A double omni-directional antenna for electromagnetic waves falling within two different frequency bands as claimed in claim 8, in which said coaxial feeder for electromagnetic waves of the higher frequency band is arranged to merge into a waveguide.

11. A double omni-directional antenna for electromagnetic waves falling within two different frequency bands as claimed in claim 1, which includes a ground plane transverse to and below said radiators, said lower rod-type radiator being a unipole having a flat design and a matching elongated form on the part of said ground plane.

12. A double omni-directional antenna for electromagnetic waves falling within two different frequency bands as claimed in claim 11, in which said elongated flat rod-type radiator as well as said upper coaxial line section arranged thereon is embedded in a fin of matching shape.

13. A double omni-directional antenna for electromagnetic waves falling within two different frequency bands comprising:

a. a double coaxial line having an inner, a central and an outer conductor forming inner and external coaxial lines;

b. a coaxial line section effective as a lower frequency band omni-directional radiator and formed by a continuation of said central and said outer conductors, said central conductor forming an inner conductor of said radiator and said outer conductor forming an outer conductor of said radiator; and c. a coaxial line section effective as a higher frequency band omni-directional radiator located above the center portion of said lower frequency band radiator and formed by a continuation of said inner and said central conductors, said inner conductor forming an inner conductor of said radiator and said central conductor forming an outer conductor of said radiator.

14. A double omni-directional antenna as claimed in claim 13, wherein said lower frequency band radiator is a unipole and said upper frequency band radiator is a slot radiator.

15. A double omni-directional antenna as claimed in claim 13, wherein at least one of said radiators is a unipole.

16. A double omni-directional antenna as claimed in claim 13, wherein at least one of said radiators is a slot radiator.

17. A double omni-directional antenna for electromagnetic waves falling within two different frequency bands comprising a double coaxial line including an inner, a central and an outer conductor which in a vertical position exhibit with respect to the lower of said frequency bands a lower coaxial line section effective as a radiator formed by said central and said outer conductors, said central conductor being the inner conductor of said lower coaxial line section and said outer conductor being the outer conductor of said lower coaxial line section, and which for the higher of said frequency bands exhibits an upper coaxial line section effective as a radiator formed by said inner and said central conductors, said inner conductor being the inner conductor of said upper coaxial line section, said central conductor being the outer conductor of said upper coaxial line section, the outer conductor of said upper coaxial line section being provided with an axial slot having a length corresponding to approximately half of the wave length of the electromagnetic waves with which said upper coaxial line section is intended to operate and in which a short circuiting pin is provided between the outer conductor and the inner conductor of said upper coaxial line section, said pin being located substantially at the center of said slot and at the edge of said slot.

18. A double omni-directional antenna for electromagnetic waves falling within two different frequency bands comprising a double coaxial line including an inner, a central and an outer conductor which in a vertical position exhibit with respect to the lower of said frequency bands a lower coaxial line section effective as a radiator formed by said central and said outer conductors, said central conductor being the inner conductor of said lower coaxial line section and said outer conductor being the outer conductor of said lower coaxial line section, and which for the higher of said frequency band exhibits an upper coaxial line section effective as a radiator formed by said inner and said central conductors, said inner conductor being the inner conductor of said upper coaxial line section, said central conductor being the outer conductor of said upper coaxial line section, the outer conductor of said upper coaxial line section being provided with an axial slot having a length corresponding to approximately half of the wave length of the electromagnetic waves with which said upper coaxial line section is intended to operate and in which said outer conductor of said upper coaxial line section has a second slot circumferentially offset through approximately 180° with respect to said first slot.

19. A double omni-directional antenna for electromagnetic waves falling within two different frequency bands comprising:

a. a double coaxial line having an inner, a central and an outer conductor forming inner and external coaxial lines;

b. a coaxial line section effective as a lower frequency band unipole and formed by a continuation of said central and said outer conductors, said central conductor forming an inner conductor of said unipole and said outer conductor forming an outer conductor of said unipole; and c. a coaxial line section effective as a higher frequency band slot radiator located above the center portion of said lower frequency band unipole and formed by a continuation of said inner and said central conductors, said inner conductor forming an inner conductor of said slot radiator and said central conductor forming an outer conductor of said slot radiator.

20. A double omni-directional antenna for electromagnetic waves falling within two different frequency bands comprising:

a. a double coaxial line having an inner, a central and an outer conductor forming inner and external coaxial lines;

b. a coaxial line section effective as a lower frequency band radiator and formed by a continuation of said central and said outer conductors, said central conductor forming an inner conductor of said radiator and said outer conductor forming an outer conductor of said radiator; and c. a coaxial line section effective as a higher frequency band radiator located above the center portion of said lower frequency band radiator and formed by a continuation of said inner and said central conductors, said inner conductor forming an inner conductor of said radiator and said central conductor forming an outer conductor of said radiator; wherein at least one of said radiators is a slot radiator.

21. The double omni-directional antenna of claim 20 in which both of said lower and higher frequency band radiators are slot radiators.

22. The double omni-directional antenna of claim 20 in which said lower frequency band radiator is a slot radiator and said higher frequency band radiator is a rod radiator.

23. A double omni-directional antenna for electromagnetic waves falling within two different frequency bands comprising:

a. a double coaxial line having an inner, a central and an outer conductor forming inner and external coaxial lines;

b. a coaxial line section effective as a lower frequency band rod radiator and formed by a continuation of said central and said outer conductors, said central conductor forming an inner conductor of said rod radiator and said outer conductor forming an outer conductor of said rod radiator; and c. a coaxial line section effective as a higher frequency band rod radiator located above the center portion of said lower frequency band rod radiator and formed by a continuation of said inner and said central conductors, said inner conductor forming an inner conductor of said rod radiator and said central conductor forming an outer conductor of said rod radiator.

* * * * *